United States Patent [19]

Patis

[11] 4,074,665

[45] Feb. 21, 1978

[54] ENGINE SPEED LIMITER

[75] Inventor: Bruce L. Patis, Waukegan, Ill.

[73] Assignee: Outboard Marine Corporation, Waukegan, Ill.

[21] Appl. No.: 190,651

[22] Filed: Oct. 19, 1971

Related U.S. Application Data

[62] Division of Ser. No. 831,007, June 6, 1969, abandoned.

[51] Int. Cl.[2] ..... F02D 11/10; F02P 1/00

[52] U.S. Cl. ..... 123/102; 123/148 E

[58] Field of Search ..... 123/102, 148 E

[56] References Cited

U.S. PATENT DOCUMENTS

| | | | |
|---|---|---|---|
| 3,356,082 | 12/1967 | Jukes | 123/102 |
| 3,406,775 | 10/1968 | Magnuski | 123/102 X |
| 3,430,615 | 3/1969 | Chavis | 123/102 |
| 3,581,720 | 6/1971 | Hemphill | 123/102 |

*Primary Examiner*—Charles J. Myhre
*Assistant Examiner*—P. S. Lall
*Attorney, Agent, or Firm*—Michael, Best & Friedrich

[57] ABSTRACT

Disclosed herein is a circuit which is connectable to an engine alternator and also to the trigger circuit of an amine ignition system to prevent overspeeding of the engine when the engine is disconected from its load. When engine output shaft attains an engine speed above a predetermined rate of rotation, the output from the engine alternator causes a current flow through a zener diode to make a transistor switch conducting, thereby providing a circuit path which grounds the ignition trigger circuit and renders the ignition trigger circuit inoperable. When the engine speed drops below the predetermined value, the zener diode blocks current flow to make the transistor switch non-conducting and open the shunt path.

5 Claims, 2 Drawing Figures

Fig. 1
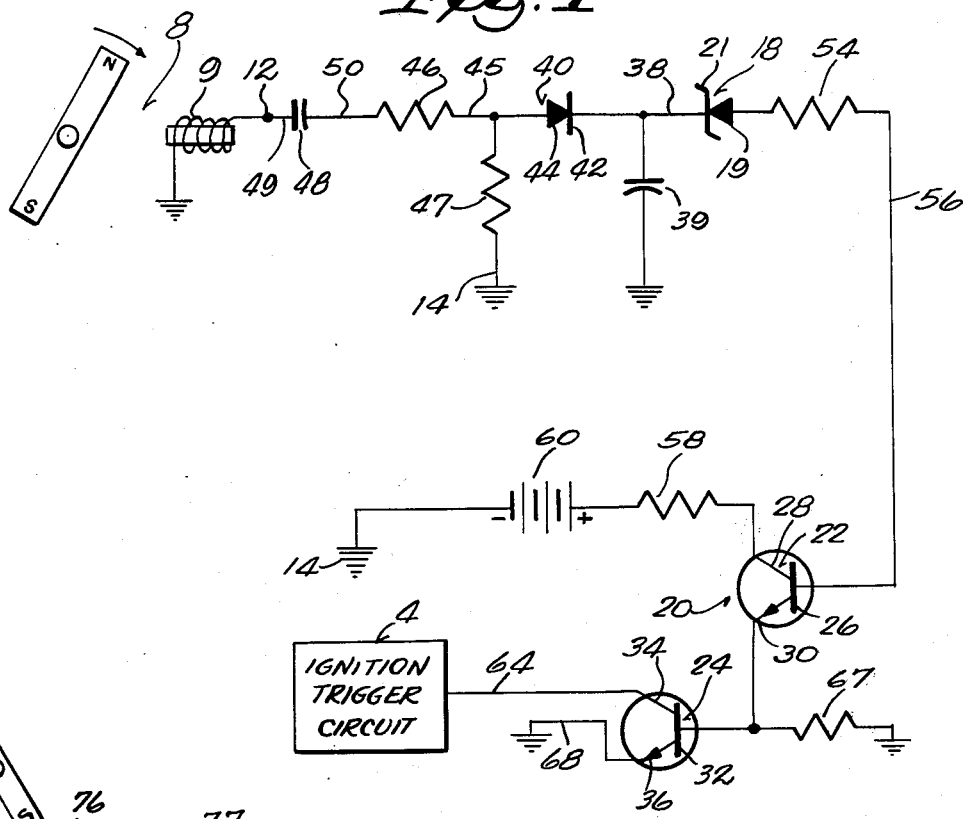
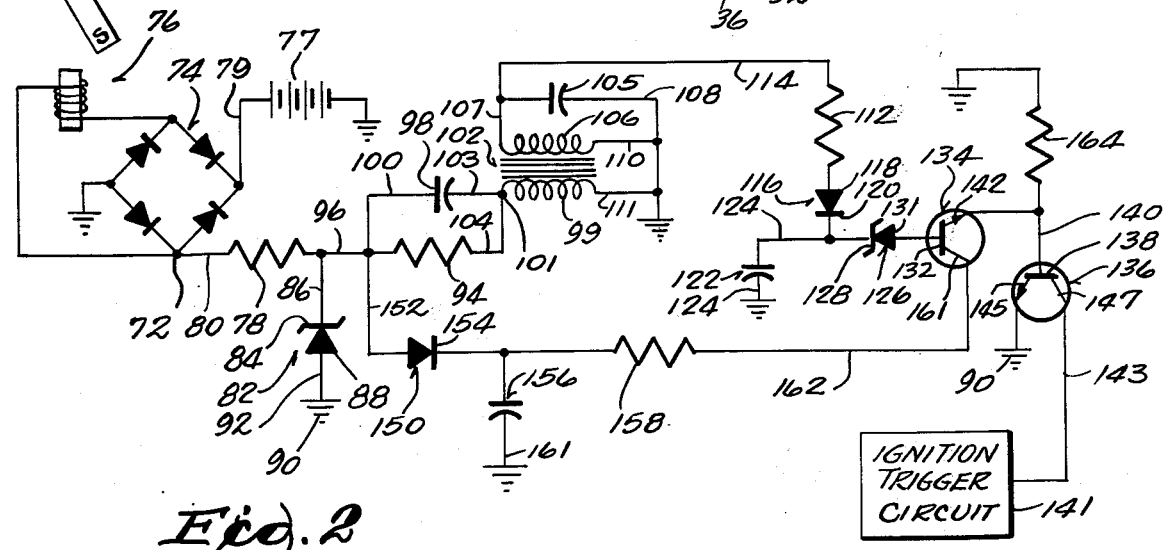
Fig. 2
INVENTOR
BRUCE L. PATIS
BY Wheeler, Wheeler, Hauser & Clemency
ATTORNEYS

ENGINE SPEED LIMITER

CROSS-REFERENCE TO RELATED APPLICATION

This application is a division of Ser. No. 831,007, filed June 6, 1969, now abandoned.

BACKGROUND OF THE INVENTION

The invention relates to devices for limiting the speed of an engine and more particularly to devices to prevent overspeeding of an engine when disconnected from its load.

It is desirable to limit the speed of an engine and to prevent accidental overspeeding when the engine is disconnected from its load. Such a condition often exists when the engine has a transmission with a neutral position, a disengageable clutch, or, in the case of a marine engine, when the propeller is partially or fully out of the water.

SUMMARY OF THE INVENTION

The invention provides a circuit which is adapted to be connected to a voltage generating device such as an engine alternator and which is also connectable to the engine ignition system. The circuit is responsive to an increase in voltage from the alternator when the engine attains a predetermined engine speed to make conducting a semi-conductor switch which completes a shunt path to ground to shunt the engine ignition and prevent continued engine operation at the high speed. More specifically, the circuit of the invention includes a zener diode and a pair of transistors. When the engine reaches a predetermined engine speed the zener diode which normally blocks current flow from the alternator breaks down or goes into avalanche and permits current flow in the reverse direction to bias the pair of transistors into a conducting state to form shunt path for grounding the ignition trigger circuit. When the alternator voltage decreases with decrease in engine speed, the zener diode blocks current flow from the alternator, thus making the transistors non-conducting to open the shunt path.

It is an object of this invention to provide a circuit which is connectable to a voltage generating device which has a variable voltage output proportional to engine speed, and which is also connectable to the trigger circuit of an ignition system and which grounds the ignition system when the engine reaches a predetermined engine speed to protect the engine from overspeeding.

It is a further object of the invention to provide a circuit which uses semi-conductor components and which prevents overspeeding of the engine.

Further objects and advantages of the present invention will become apparent from the following description and accompanying drawing.

DRAWING

FIG. 1 is a schematic diagram of an engine speed limiting circuit in accordance with the invention.

FIG. 2 is a schematic diagram of a further embodiment of the invention.

DETAILED DESCRIPTION

In FIG. 1 there is shown an ignition trigger circuit 4 which is connected to a spark plug 6. FIG. 1 also shows a voltage generating device 8 which can be a magneto, generator, or a permanent magnet alternator. As disclosed, the voltage generating device 8 is a permanent magnet alternator with a stator or field winding 9.

The invention provides a speed limiting circuit 10 which includes a first input terminal 12 and a second input terminal 14 which, in the disclosed construction, is ground. The circuit 10 also includes a first switch 18 and a second switch 20. As disclosed, the first switch 18 comprises a zener diode which has an anode 19 and cathode 21. The second switch 20 comprises first and second transistors 22 and 24. The transistor 22 has a base 26, a collector 28 and an emitter 30. The second transistor 24 has a base 32, a collector 34 and an emitter 36.

In accordance with the invention, means are provided for electrically connecting the first switch 18 and the second switch 20 and for connecting the first switch 18 to the input terminal 12 so that the first switch 18 is operable in response to an increase in the voltage produced by the voltage generating device 8 as the engine exceeds a predetermined engine speed to close the second switch 20 and provide a shunt path between the ignition trigger circuit 4 and ground 14 to interrupt operation of the ignition trigger circuit and so that the first switch 18 is operable upon a decrease in engine speed below the predetermined speed value to open the second switch 20 and open the shunt path. As disclosed, the first switch 18 comprises a zener diode and the means for electrically connecting the first switch 18 and the second switch 20 to the input terminal 12 includes a lead 38 which connects the cathode 21 of zener diode 18 to the cathode 42 of a diode 40. The anode 44 of diode 40 is connected by a lead 45 to one terminal of a resistor 46. The other terminal of the resistor 46 is connected by a lead 50 to one terminal of a capacitor 48. The other terminal of the capacitor 48 is connected to the input terminal 12 by a lead 49. The anode 44 of the diode 40 is connected to ground 14 through a resistor 47. The resistors 46 and 47 from a voltage divider so that calibration of the circuit can be achieved by using different values of resistor 47. The means also includes a capacitor 39 which has one terminal connected to the cathode 21 of the zener diode 18 and the other terminal connected to ground 14.

The means for electrically connecting the first switch or zener diode 18 to the transistor switch 20 also includes a resistor 54 which has one terminal connected to the cathode 19 of zener diode 18 and the other terminal connected to a lead 56 which is connected to the base 26 of transistor 22.

The collector 28 of transistor 22 is connected to one terminal of a resistor 58. The other terminal of the resistor 58 is connected to a battery 60, or other source of electrical energy. The emitter of transistor 22 is connected to the base 32 of the transistor 24 by a lead 62. The collector of the transistor 24 is connected to the ignition trigger circuit 4 by a lead 64. The base 32 of the transistor 24 is grounded by a lead 66, which is connected to one side of resistor 67. The other side of resistor 67 is connected to ground 14. The emitter 36 of transistor 24 is grounded by a lead 68.

In operation of the circuit disclosed in FIG. 1, the output of the voltage generating device 8 is proportional to engine speed. Thus, the current applied to capacitor 48 increases with increase in the speed of rotation of the voltage generating device 8. The diode 40 rectifies the voltage which thus charges the capacitor 39. When capacitor 39 is charged to a sufficient voltage to cause a breakdown or avalanche of the zener diode 18, a current flows through resistor 54 to the base 26 of the transistor 22 making it conducting so that a current flows from the battery 60 through resistor 58 and transistor 22 causing it to make transistor 24 conducting and shunt or ground the ignition trigger circuit 4 to render the ignition circuit 4 inoperable. The shunt path includes leads 64 and 68.

When the engine speed drops below the predetermined speed value, and thus the voltage output of the voltage generating device 8 decreases, the zener diode 17 will revert to its normal blocking state and interrupt flow from the voltage generating device 8 causing the transistors 22 and 24 to become nonconducting and thus open the shunt path from the ignition trigger circuit to ground.

In one embodiment of the invention the values for circuit components for the circuit disclosed in FIG. 1 are as follows: the capacitor 48 has a value of 0.01 microfarads, 200 volts; capacitor 39 has a value of 0.47 microfarads, 50 volts; the zener diode 18 is a 1N 4370A; the transistors 22 and 24 are MPS 6531; resistor 46 is 100 ohms; resistor 47 is 0 to 3000 ohms; resistor 54 is 10,000 ohms; resistors 58 and 67 are 1000 ohms; the diode 40 is a 1N 2069 silicon rectifier.

FIG. 2 discloses a further embodiment of the invention. In this embodiment, an input terminal 72 is shown connected to the rectifier bridge 74 of an alternator 76. The bridge 74 is also connected to a battery 77 by a lead 79. The pulses produced by the alternator pass through a clipper stage which includes a first resistor 78 which is connected to the input terminal 72 by a lead 80 and a first zener diode 82 which has a cathode 84 connected to the other terminal of resistor 78 by a lead 86. The anode 88 of the zener diode 82 is connected to ground 90 by a lead 92.

The clipped pulse is then fed through a high pass filter stage comprising a second resistor 94 which is connected to the first resistor 78 by a lead 96 and a first capacitor 98 which has one terminal connected to lead 96 by a lead 100. The other terminal of capacitor 98 and the other terminal of the second resistor 94 are connected by leads 103 and 104 to terminal 101 of the primary 99 of a transformer 102.

The transformer 102 forms a resonant circuit or stage with a second capacitor 105 which has one terminal connected to each of the terminals of the secondary 106 by leads 107 and 108. The primary 99 and secondary 106 are grounded by leads 110 and 111. The output of the resonant circuit formed by transformer 102 and capacitor 105 is quite low until a certain frequency is attained with increase in engine speed, thereby sharply increasing the output voltage at that point in the circuit.

The output voltage coming from the resonant circuit is rectified and filtered by a third resistor 112 which has one terminal connected to the secondary 106 of the transformer by a lead 114 and by a first diode 116 which has an anode 118 connected to the other terminal of resistor 112. The cathode 120 of the first diode 116 is connected to one terminal of a third capacitor 122. The other terminal of the third capacitor 122 is grounded by a lead 124. Thus, a DC voltage appears across the first switch or second zener diode 126 which has a cathode 128 connected to the cathode 120 of diode 116 by a lead 130. The anode 131 of the second zener diode 126 is connected to the base 132 of a first transistor 134 which forms part of the second switch. The second zener diode 126 blocks current to transistor 134 until the output of transformer 102, capacitor 105, diode 116, resistor 112 and capacitor 122 is higher than the zener voltage of zener diode 126. The transistor 134 then becomes conducting and turns on a second transistor 136 which forms part of the second switch and which has a base 138 connected by a lead 140 to the emitter 142 of the first transistor 134. When the transistor 136 becomes conducting, the ignition trigger circuit 141 is shunted to ground, thus rendering the trigger circuit and the engine inoperable. The shunt path includes a lead 143 which connects the ignition trigger circuit 141 to the collector 147 of the transistor 136 and a lead 144 which connects the emitter 145 of the transistor 136 to ground 90.

The embodiment of the invention disclosed in FIG. 2 also provides a regulated DC power supply to operate the transistors 134 and 136. In this regard, a part of the clipped pulses from diode 82 is supplied to a second diode 150 by a lead 152, which is connected to lead 96. The cathode 154 of the second diode 150 is connected to one terminal of a fourth capacitor 156 and one terminal of a fourth resistor 158 by a lead 160. The other terminal of the fourth capacitor 156 is connected to ground by a lead 161. The other terminal of the fourth resistor 158 is connected to the collector 161 of transistor 134 by a lead 162. The resistor 158 limits the collector current of transistor 134 and the base current of the transistor 136. The circuit also includes a fifth resistor 164 which is connected between the emitter 142 of transistor 134 and ground to minimize leakages of various components which could unintentionally make transistors 136 conducting.

In one embodiment of the circuit shown in FIG. 2, the various components have the following values; capacitor 98 is 0.25 microfarads, 50 volts; capacitor 105 is chosen for calibration; capacitor 122 is 0.22 microfarads; capacitor 156 is 15 microfarads; diode 82 is a 1N4737A; diodes 116 and 150 are 1N4003 diodes; diode 126 is a 1N5221B diode; transistors 134 and 136 are MPS6531 transistors; resistor 78 is 680 ohms; resistor 94 is 4700 ohms; resistors 112 and 164 are 10,000 ohms; resistor 158 is 1000 ohms, and the transformer 102 has a 1:15 turn ratio.

Various of the features of the invention are set forth in the following claims.

What is claimed is:

1. Apparatus for interrupting ignition operation, said apparatus comprising an ignition trigger circuit, a first capacitor, a first resistor, a lead connecting one terminal of said first capacitor with a voltage generating device, a lead connecting the other terminal of said first capacitor with one side of said first resistor, a diode having an anode and a cathode, a lead connecting the anode of said diode to the other side of said first resistor, a second resistor, a lead connecting one side of said second resistor to the anode of said diode, a lead connecting the other side of said second resistor to ground, a zener diode having an anode and a cathode, a lead connecting the cathode of said zener diode with the cathode of said diode, a second capacitor, a lead connecting one terminal of said second capacitor with the cathode of said zener diode, a lead connecting the other terminal of said capacitor to ground, a third resistor, a lead connecting one side of said third resistor to the anode of said zener diode, a first transistor having a base, emitter and collector, a lead connecting the other side of said third resistor to the base of said first transistor, fourth and fifth resistors, a lead connecting the collector of said first transistor to one side of said fourth resistor, a battery, a lead connecting the other side of said fourth resistor to one side of said battery, a lead connecting the other side of said battery to ground, a lead connecting the emitter of said first transistor to said fifth resistor, a lead connecting the other side of said fifth resistor to ground, a second transistor having a base, a collector and an emitter, a lead connecting said base of said second transistor with said emitter of said first transistor, a lead connecting said emitter of said second transistor to ground, and a lead connecting said collector of said second transistor to said ignition trigger circuit.

2. A circuit for limiting the speed of an engine, said circuit comprising an input terminal adapted to be connected to the rectifier bridge of a voltage generating device, a first resistor having one terminal connected to said input terminal and a first zener diode having a cathode and anode, said cathode being connected to the other terminal of said first resistor and said anode being connected to ground, a second resistor, said second resistor having a terminal connected to said cathode of said first zener diode, a first capacitor having a terminal connected to said terminal of said second resistor, a transformer having a primary and secondary, said other terminal of said first capacitor and said other terminal of said second resistor being connected to one side of said primary of said transformer, the other side of said primary and one side of said secondary of said transformer being connected to ground, a second capacitor, one terminal of said second capacitor being connected to the other side of said secondary of said transformer, the other terminal of said second capacitor being connected to ground, a third resistor, said other side of said secondary of said transformer being connected to one side of said third resistor, a first diode having an anode and cathode, said anode of said first diode being connected to the other side of said third resistor, a second zener diode having a cathode and anode, said cathode of said second zener diode being connected to said cathode of said first diode, a third capacitor, one terminal of said third capacitor being connected to said cathode of said second zener diode, the other terminal of said third capacitor being connected to ground, a first transistor having a base, a collector and emitter, said base of said first transistor being connected to said anode of said second zener diode, a fourth resistor, one terminal of said fourth resistor being connected to said collector of said first transistor, a fourth capacitor, one terminal of said fourth capacitor being connected to the other side of said fourth resistor, the other terminal of said fourth capacitor being connected to ground, a second diode having an anode and cathode, said cathode of said second diode being connected to said one terminal of said fourth capacitor, said anode of said second diode being connected to said cathode of said first zener diode, a second transistor having a base, collector and emitter, said base being connected to said emitter of said first transistor, said emitter of said second transistor being connected to ground, a fifth resistor having one terminal connected to ground and another terminal connected to said emitter of said first transistor, and an ignition trigger circuit having an ungrounded terminal, said terminal being connected to said collector of said second transistor.

3. A control for limiting engine speed comprising an ignition circuit operable to cause ignition and consequent engine operation, a first transistor connected between said ignition circuit and a ground, a second transistor connected between a voltage source and said first transistor to cause first transistor operation affording flow from said ignition circuit to ground in response to current flow from the voltage source to said first transistor, a zener diode connected to said second transistor to cause current flow from the voltage source to said first transistor in response to current flow from said zener diode to said second transistor, a voltage generator responsive to engine speed and connected to said zener diode to cause current flow from said zener diode to said second transistor in response to voltage generation occurring in response to engine operation above a predetermined speed, a pulse clipper stage connected to said voltage generator, a filter stage connected to said clipper stage, a resonant circuit including a transformer and capacitor and connected to said filter stage, a filter connected to said resonant circuit, and a rectifier connected to said zener diode and to said resonant circuit, whereby said ignition circuit is grounded to thereby discontinue engine operation when engine speed advances above the predetermined engine speed.

4. Apparatus for preventing engine overspeed operation by interrupting ignition operation, said apparatus comprising an ignition trigger circuit, a voltage generating device including a relatively rotatable magnet and coil operable to generate voltage of increasing magnitude in response to increasing engine speed, a first diode having a cathode and an anode electrically connected to said voltage generating device, a zenor diode having an anode and a cathode, a capacitor connected between ground and each of said first diode cathode and said zenor diode cathode, a first transistor having a base connected to said zener diode anode, an emitter and a collector, a voltage source connected between ground and said first transistor collector, and a second transistor having a base connected to ground and to said first transistor emitter, a collector connected to said ignition trigger circuit, and an emitter connected to ground.

5. Apparatus for preventing engine overspeed operation by interrupting ignition operation, said apparatus comprising an ignition trigger circuit, a voltage generating device operable to generate voltage of increasing magnitude in response to increasing engine speed, a first diode having an anode connected to ground and a cathode, a first capacitor connected between said first diode anode and said voltage generating device, a zener diode having an anode and a cathode, a second capacitor connected between ground and each of said first diode cathode and said zener diode cathode, a first transistor having a base connected to said zener diode anode, an emitter, and a collector, a voltage source connected between ground and said first transistor collector, and a second transistor having a base connected to ground and to said first transistor emitter, a collector connected to said ignition trigger circuit, and an emitter connected to ground.

* * * * *